US010106921B2

(12) United States Patent
Ciocca

(10) Patent No.: US 10,106,921 B2
(45) Date of Patent: Oct. 23, 2018

(54) METHODS FOR THE MANUFACTURE OF INVISIBLE TYPE SOCKS

(71) Applicant: VAL-FIN S.R.L., Quinzano d'oglio (Brescia) (IT)

(72) Inventor: Giuseppe Ciocca, Quinzano d'Oglio (IT)

(73) Assignee: VAL-FIN S.R.L., Quinzano d'Oglio (Brescia) (IT)

( * ) Notice: Subject to any disclaimer, the term of this patent is extended or adjusted under 35 U.S.C. 154(b) by 36 days.

(21) Appl. No.: 15/316,842

(22) PCT Filed: Jun. 12, 2015

(86) PCT No.: PCT/IB2015/054471
§ 371 (c)(1),
(2) Date: Dec. 7, 2016

(87) PCT Pub. No.: WO2015/189824
PCT Pub. Date: Dec. 17, 2015

(65) Prior Publication Data

US 2017/0096754 A1 Apr. 6, 2017

(30) Foreign Application Priority Data

Jun. 12, 2014 (IT) ..... TO2014A0472

(51) Int. Cl.
*D04B 1/26* (2006.01)
*D04B 1/10* (2006.01)
*A41B 11/04* (2006.01)

(52) U.S. Cl.
CPC ..... *D04B 1/26* (2013.01); *A41B 11/04* (2013.01); *D04B 1/106* (2013.01); *A41B 2500/10* (2013.01)

(58) Field of Classification Search
CPC ..... D04B 1/26; D04B 1/106; A41B 11/04
See application file for complete search history.

(56) References Cited

U.S. PATENT DOCUMENTS 2,306,246 A * 12/1942 Davis ..... D04B 1/26 66/172 E
2,357,506 A * 9/1944 Davis ..... D04B 1/26 66/172 E (Continued)

FOREIGN PATENT DOCUMENTS

EP 2043466 B1 9/2012
IT 1118105 B 2/1986

(Continued)

OTHER PUBLICATIONS

David J. Spencer, The manufacture of hosiery on small-diameter circular machines, Knitting technology—A comprehensive handbook and practical guide, 2001, pp. 256-273, Woodhead Publishing Limited, Cambridge, UK, ISBN: 978-1-85573-333-6, XP002731053.

*Primary Examiner* — Danny Worrell
(74) *Attorney, Agent, or Firm* — Robert E. Alderson, Jr.

(57) ABSTRACT

Methods for making invisible-type socks are provided. Such methods include steps of manufacturing using a circular knitting machine with latch needles, a decreased knitted heel portion, forming a rear part of an opening or mouth for the introduction of a foot, an intermediate body portion, manufactured in continuation of the heel portion and forming a front part of the opening or mouth, and a toe portion, manufactured in continuation of the intermediate body portion; and sewing to one another respective end edges or selvedges of the intermediate body portion and the toe portion. Additionally, the circular knitting machine is supplied with a continuous yarn made of an adhesive synthetic material, in particular silicone, having a count within a predetermined range.

10 Claims, 2 Drawing Sheets

(56) References Cited

U.S. PATENT DOCUMENTS 2,848,885 A * 8/1958 Goodman ..... A43B 23/28 12/142 G
2,977,782 A * 4/1961 Sheek ..... A41B 11/12 2/DIG. 9
3,130,566 A * 4/1964 Chesebro ..... A41B 11/00 2/239
3,274,804 A * 9/1966 Thorneburg ..... A41B 11/00 2/239
3,600,909 A * 8/1971 Kaplan ..... A41B 11/10 66/171
3,729,956 A * 5/1973 Nebel ..... A41B 11/04 66/172 E
3,906,753 A 9/1975 Siegfried
3,908,407 A * 9/1975 Brand ..... D04B 1/106 66/172 E
4,172,370 A 10/1979 Safrit et al.
4,282,726 A * 8/1981 Wilkins ..... D04B 1/106 66/172 E
4,282,727 A * 8/1981 Dunlap ..... D04B 1/26 66/172 E
4,304,108 A * 12/1981 Chamlee ..... D04B 1/106 2/239
4,326,393 A * 4/1982 Dunlap ..... D04B 1/26 66/172 E
5,560,226 A * 10/1996 Throneburg ..... A41B 11/02 2/239
5,603,232 A * 2/1997 Throneburg ..... A41B 11/02 2/239
6,173,589 B1 * 1/2001 Hayes, Jr. ..... A41B 11/10 2/239
6,178,785 B1 * 1/2001 Samata ..... D04B 1/26 2/239
6,415,632 B1 * 7/2002 Vesnaver ..... A41B 11/10 66/185
7,738,991 B2 * 6/2010 Klumpp ..... D04B 1/26 66/185
7,937,972 B2 * 5/2011 Busi ..... D04B 1/108 66/185
2009/0314039 A1 * 12/2009 Klumpp ..... D04B 1/26 66/187
2016/0120233 A1 * 5/2016 Van Tiel ..... A43B 17/00 2/239

FOREIGN PATENT DOCUMENTS

JP 2000160403 A 6/2000
JP 2001123363 A 5/2001
WO 03008685 A1 1/2003
WO 2008006525 A1 1/2008

* cited by examiner

METHODS FOR THE MANUFACTURE OF INVISIBLE TYPE SOCKS

CROSS-REFERENCE TO RELATED APPLICATIONS

This application is a National Phase Application of PCT International Application No. PCT/IB2015/054471, International Filing Date, Jun. 12, 2015 claiming priority to Italian Patent Application No. TO2014A000472 filed Jun. 12, 2014, each of which is hereby incorporated by reference in its entirety.

FIELD OF THE INVENTION

The present invention relates, in general, to the field of manufacturing knitted hosiery.

More specifically, the invention relates to methods for making socks of the so-called invisible type and socks of this type, as described and claimed herein.

BACKGROUND OF THE INVENTION

Knitted socks of the "invisible" or "secret" type are widely used and appreciated. They have no leg portion, and extend below the ankle, so that, in use, they do not emerge from the footwear, but remain "concealed" within the footwear.

A problem that is frequently encountered in the use of these invisible socks is the tendency of their rear part to fall down and bunch up in a rather troublesome way under the sole of the user's foot.

To overcome this problem, WO2008/006525A1 proposes the application of at least one localized protruding element of adhesive polymer material, particularly an elastomeric material (such as silicone), to the inner surface of the rear part or heel of these socks, this material being adapted to increase the friction between the sock and the foot.

This solution, based primarily on the creation of a non-slip effect, cannot be implemented directly in knitting machines used for manufacturing socks.

The application of the aforesaid non-slip elements is carried out subsequently, and, when executed in a "mechanized" way, represents a complication of the production process, requiring additional processing that has a significant effect on the final cost of the products.

Moreover, the aforesaid non-slip elements may also be uncomfortable. They also fail to increase the friction between the sock and the footwear.

Another known solution, which is an alternative to the non-slip elements described above, provides for the insertion into various different parts of an invisible sock of threads or yarns made of elastomeric materials, covered if necessary (for example, polyamide-covered "elastane", or nylon-covered Lycra™), which are capable of providing an elastic compressive action in order to improve the adhesion of the sock to the foot by impeding the slipping of the sock.

SUMMARY OF THE INVENTION

One object of the present invention is therefore to provide a method for the manufacture of knitted socks of the so-called invisible type, which enables the aforementioned drawbacks of the prior art solutions to be overcome.

This and other objects are achieved according to the present invention with methods and products as described and claimed herein.

The upper part of the heel portion is manufactured with at least one knitted course.

Conveniently, this upper part of the heel portion is manufactured with a number of knitted courses in the range from one to twenty, and preferably with twelve knitted courses.

The method according to the present invention can conveniently be executed by means of a single-cylinder circular knitting machine with latch needles, having a gauge (the number of needles present in one inch of the circumference of the cylinder) of between 70 and 18, or a double-cylinder machine having a gauge of between 26 and 3.

The scope of the present invention also includes knitted socks of the so-called invisible type manufactured by the method defined above.

Other features and advantages of the invention will become clear from the following detailed description given purely by way of non-limiting examples with reference to the attached drawings.

DETAILED DESCRIPTION

Figure 1:
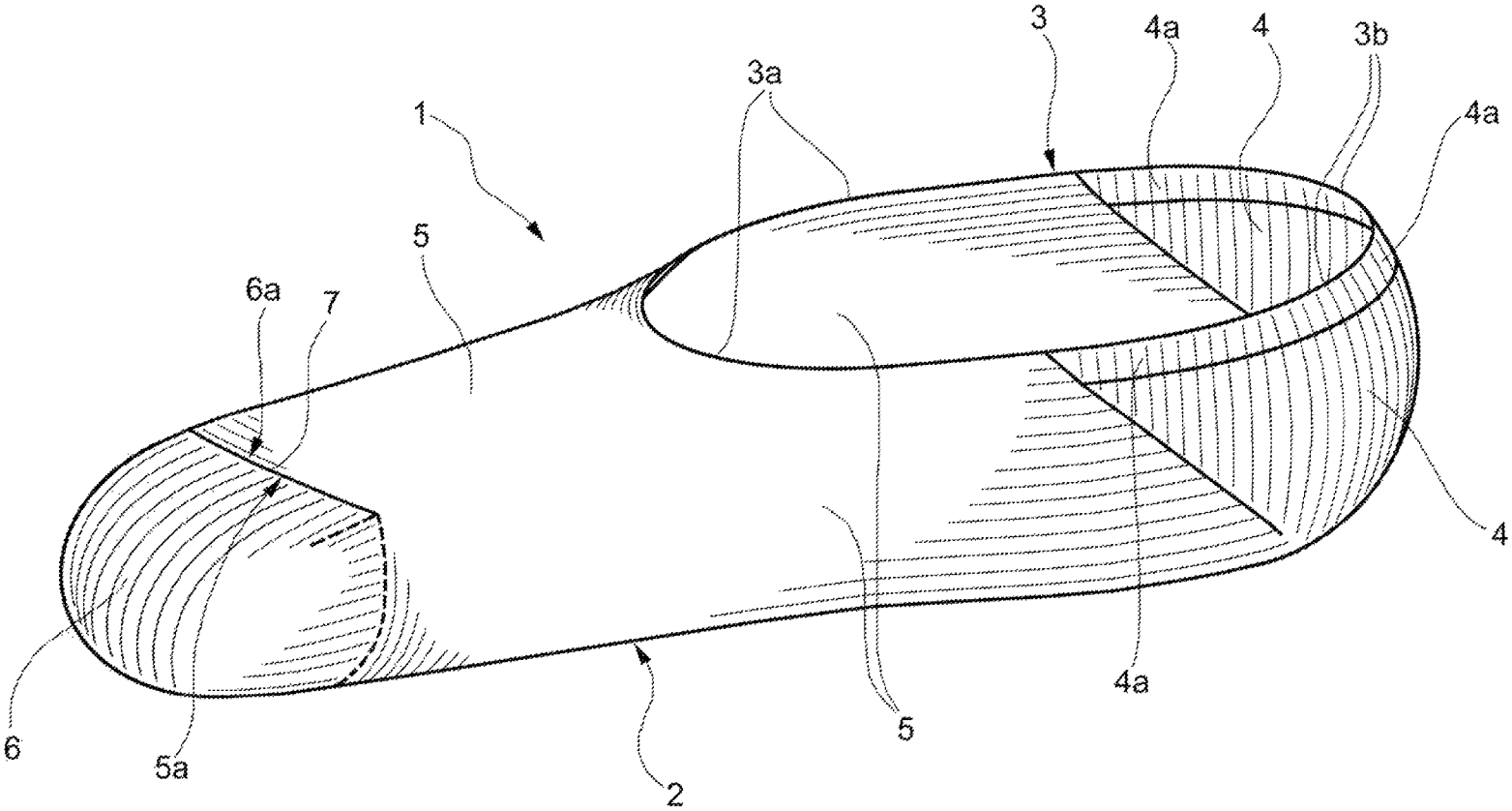
FIG. 1 is a perspective view of a sock of the invisible type made according to the present invention.

In the drawings, the number 1 indicates the whole of a knitted sock of the so-called invisible or secret type.

This sock 1 comprises a sock body 2 having a top opening or mouth 3 for the introduction of a user's foot.

The sock body 2 comprises a decreased knitted heel portion 4, forming the rear part 3*b* of the opening or mouth 3.

The sock body 2 also has an intermediate body portion 5, made in continuation of the heel portion 4.

The intermediate body portion 5 comprises a decreased knitted part, extending to the front end of the opening or mouth 3 for the introduction of the foot, and a further tubular knitted part made in continuation of said decreased knitted part.

For manufacturing socks of the "ballerina" or very "low-cut" type, this tubular knitted part may if necessary be reduced to a minimum number of knitted courses, sufficient to allow sewing to the toe portion 6 of the sock.

The intermediate body portion 5 forms the front part 3*a* of said opening or mouth 3.

The toe portion 6 of the sock 1 is manufactured by decreased knitting, in continuation of the intermediate body portion 5.

The toe portion 6 has an edge or selvedge 6*a* sewn to a corresponding edge or selvedge 5*a* of the intermediate body portion 5. The sewing of said edges is indicated by 7.

According to the invention, the heel portion 4 of the invisible sock 1 has an upper part 4*a* which defines the rear part 3*b* of the opening or mouth for the introduction of the foot.

This upper part 4*a* of the heel portion 4 is made with a continuous yarn, in particular a monofilament yarn, made of an adhesive synthetic material, in particular silicone, having a count preferably between about 400 dtex and about 4,500 dtex.

Suitable yarns for this purpose are, for example, those produced and marketed under the trade name "Muriel" (registered trademark) by the company LeMur S.p.A of Ala, Trento, Italy.

For the manufacture of the invisible sock 1 shown in FIG. 1, it is convenient to use a circular knitting machine with latch needles, such as the model G "00" machine produced by the company Lonati S.p.A. of Brescia, Italy.

The circular knitting machine used may be of the single-cylinder or two-cylinder type.

If a single-cylinder knitting machine is used, the yarn of adhesive synthetic material, in particular silicone, used to manufacture the upper part 4*a* of the heel portion 4 of the socks 1 has a count which varies according to the gauge of the machine: the count of this yarn can vary from about 400 dtex, when a single-cylinder machine having a gauge of about 70 is used, up to 4,500 dtex when a single-cylinder machine with a gauge of 18, or a two-cylinder machine with a gauge of 6, is used.

The upper part or band 4*a* of the heel portion 4 of the socks 1 is manufactured with at least one knitted course, in other words two strokes (a stroke in one direction and a stroke in the opposite direction).

Conveniently, said upper part or band 4*a* of the heel portion 4 is manufactured with a number of knitted courses between one and twenty, and preferably with twelve knitted courses, made with said yarn of adhesive synthetic material, in particular silicone.

The upper part or band 4*a* of the heel portion 4 is advantageously manufactured in the same circular knitting machine as that used for manufacturing the sock 1, without the need for further processes such as subsequent manual or mechanical application of added elastomeric materials.

The solution according to the present invention therefore provides a significant economy in the process and an appreciable simplicity and rapidity of manufacture.

In use, the upper part 4*a* of the heel portion 4 provides a primarily adhesive action in relation to the user's foot, this action effectively opposing the tendency of this portion of the invisible sock to fall down and bunch up in a troublesome way under the user's sole.

This slip prevention action is based primarily on the characteristics of adhesiveness and shape, more than on any elasticity, of the upper part 4*a* of the heel portion 4 of the sock.

Figure 2:
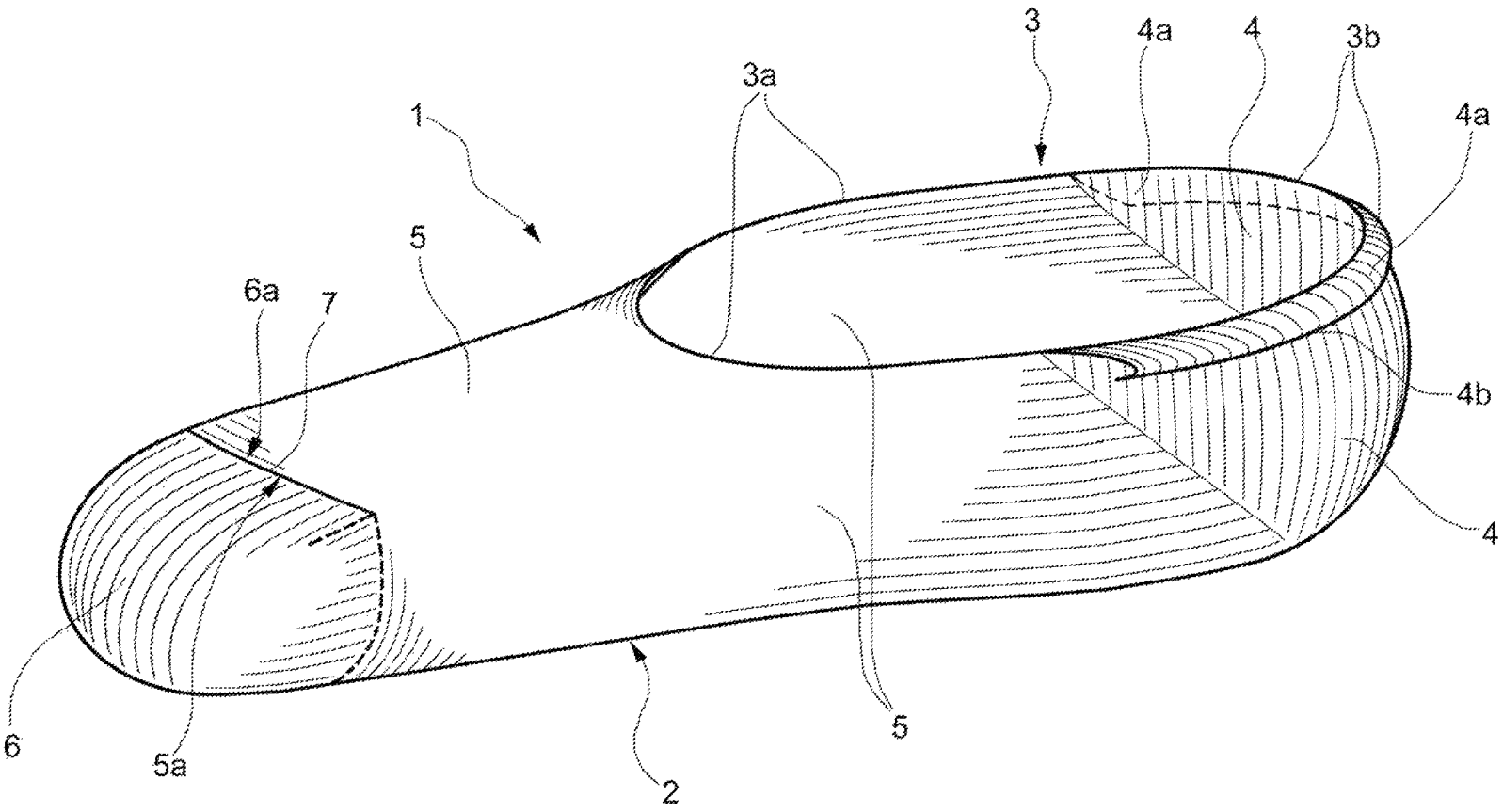
FIG. 2 shows another sock made according to the present invention.

FIG. 2 of the attached drawings shows a variant embodiment. In this figure, parts and elements identical or corresponding to parts and elements described previously have been given the same reference numerals as those used previously.

In the embodiment shown in FIG. 2, the upper part or band 4*a* of the heel portion 4 comprises at least three knitted courses, corresponding to six strokes, and is turned towards the outside, and its end edge 4*b* is attached or "hooked", or sewn, to the outer surface of the heel portion 4, in such a way that the part or band 4*a* of the heel portion has an essentially tubular configuration.

The sock 1 according to FIG. 2 can also advantageously be manufactured entirely in a circular knitting machine with latch needles, and therefore does not require the use of subsequent additional processes.

The socks 1 described with reference to FIGS. 1 and 2 have many advantages.

The most significant advantage is that they overcome the problem of preventing the rear part of the sock from falling down or bunching up under the sole of the foot, which would otherwise make the use of the sock troublesome.

Furthermore, the novel and efficient production process enables manufacturing to take place even in the so-called advanced countries which are characterized by high labour costs in the textile industry, thus avoiding the use of outsourcing. By manufacturing in the aforesaid countries, using local workers, it is also possible to improve the social conditions in these countries and to provide positive effects on their economies, with a reduction or elimination of transport costs and the concomitant pollution, by comparison with production in distant countries with low labour costs.

The invention claimed is:

1. A method for the manufacture of a knitted sock of the so-called invisible type, having no leg portion, extending below an ankle, and comprising a sock body having an opening or mouth for the introduction of a foot, said opening or mouth comprising a front part and a rear part, wherein the manufacture of the sock body comprises the steps of:

manufacturing, using a circular knitting machine with latch needles:

a decreased knitted heel portion, forming the rear part of said opening or mouth, an intermediate body portion, manufactured in continuation of the heel portion and forming the front part of said opening or mouth, and a toe portion, manufactured in continuation of the intermediate body portion; and sewing to one another respective end edges or selvedges of the intermediate body portion and the toe portion;

wherein said circular knitting machine is supplied with a continuous yarn comprising adhesive synthetic material for adhering the invisible sock to a user's foot, thus opposing a tendency of the invisible sock to bunch up, wherein an upper part of the heel portion, which defines the rear part of said opening or mouth, is manufactured in said machine, using said continuous yarn, and wherein said upper part of the heel portion is turned towards outside, and its end edge or selvedge is attached to an outer surface of the heel portion, in such a way that said upper part of the heel portion has an essentially tubular configuration.

2. The method of claim 1, wherein said continuous yarn has a count of between 400 dtex and 4,500 dtex.

3. The method of claim 1, wherein said upper part of the heel portion is manufactured with at least one knitted course made with said continuous yarn.

4. The method of claim 1, wherein said upper part of the heel portion is manufactured comprising from 1 to 20 knitted courses.

5. The method of claim 1, wherein said upper part of the heel portion is manufactured with at least three knitted courses, corresponding to six strokes.

6. The method of claim 1 wherein a single-cylinder circular knitting machine is used.

7. The method of claim 6, wherein said circular knitting machine has a gauge of between 70 and 18, the gauge being the number of needles present in one inch of the circumference of the single-cylinder.

8. The method of claim 1, wherein a two-cylinder circular knitting machine is used.

9. The method of claim 8, wherein said two-cylinder circular knitting machine has a gauge of between 26 and 3, the gauge being the number of needles present in one inch of the circumference of the two-cylinder.

10. The method of claim 1, wherein said continuous yarn comprises silicone.

* * * * *